United States Patent [19]

Koga et al.

[11] Patent Number: 4,945,301

[45] Date of Patent: Jul. 31, 1990

[54] CONSTANT-VOLTAGE POWER SUPPLY CIRCUIT AND AMPLIFIER CIRCUIT AND DA CONVERTER USING THE CONSTANT-VOLTAGE POWER SUPPLY CIRCUIT

[75] Inventors: Yoshiro Koga; Hiroshi Kume; Kenji Nakao, all of Neyagawa, Japan

[73] Assignee: Onkyo Kabushiki Kaisha, Japan

[21] Appl. No.: 205,459

[22] Filed: Jun. 10, 1988

[30] Foreign Application Priority Data

Jun. 12, 1987 [JP] Japan ..... 62-090961[U]
Sep. 7, 1987 [JP] Japan ..... 62-137293[U]
Sep. 7, 1987 [JP] Japan ..... 62-224755

[51] Int. Cl.[5] ..... G05F 1/44

[52] U.S. Cl. ..... 323/902; 323/282; 323/284; 341/144; 363/21

[58] Field of Search ..... 323/902, 903, 273, 274, 323/284, 905, 282, 292, 349, 351, 281; 341/137, 126, 144; 307/311, 362, 363; 250/551

[56] References Cited

U.S. PATENT DOCUMENTS 3,321,631 5/1967 Biard et al. ..... 323/902
3,359,483 12/1967 Biard ..... 323/902
3,737,756 6/1973 Hasley et al. ..... 363/21
3,958,175 5/1976 Braun ..... 323/902
4,366,432 12/1982 Noro ..... 323/224
4,761,702 8/1988 Pinard ..... 363/21

OTHER PUBLICATIONS

R. C. Foss, "A Junk-Box 5-Volt Power Supply", May 1976, Popular Electronics.

*Primary Examiner*—William M. Shoop, Jr.
*Assistant Examiner*—Romano
*Attorney, Agent, or Firm*—Webb, Burden, Ziesenheim & Webb

[57] ABSTRACT

A constant-voltage power supply circuit having a light-emitting element and a photosensitive element optically coupled with each other and a driving power source for driving the light emitting element, the circuit using an output voltage of the photosensitive element as a reference voltage; and an amplifier circuit using a constant current converted from the reference voltage of the constant-voltage power supply circuit; and a DA converter adapted for delivering binary digital signals to the constant-voltage power supply circuit.

17 Claims, 7 Drawing Sheets

CONSTANT-VOLTAGE POWER SUPPLY CIRCUIT AND AMPLIFIER CIRCUIT AND DA CONVERTER USING THE CONSTANT-VOLTAGE POWER SUPPLY CIRCUIT

BACKGROUND OF THE INVENTION

1. FIELD OF THE INVENTION

The present invention relates to a constant-voltage power supply circuit and an amplifier circuit and a DA converter using the constant-voltage power supply circuit.

2. DESCRIPTION OF THE PRIOR ART

A typical conventional constant-voltage power supply circuit, as shown in FIG. 8*a*, essentially comprises a pair of input terminals 01*a* and 01*b*, a control transistor 03 having its emitter connected to one of the input terminals 01*a* and its collector connected to one output terminal 02*a* of a pair of output terminals 02*a* and 02*b*, a Zener diode 04 acting as a reference voltage source and connected to a base of the control transistor 03 and to the other input terminal 01*b* and output terminal 02*b* and a resistance 5 connected between the emitter and the base of the control transistor 03. In operation, when a rectified voltage is applied to the input terminals 01*a* and 01*b*, a constant voltage output is obtained from the output terminals 02*a* and 02*b*.

In the above-described constant-voltage power supply circuit, if the rectified voltage contains ripple components, the ripple components are delivered as fluctuating components via the resistance 05 to the Zener diode. As the result, there occurs the problem of inadvertent variation of the output voltage due to fluctuations in the Zener voltage.

If the ripple components is $e_L$, resistance 05 is R, and the Zener diode has an operational resistance of $r_D$; then, the output voltage fluctuating components $e_S$ is represented by:

$$e_s = \frac{r}{R + r_0} e_L$$

Also, in the above constant-voltage power supply circuit, two methods have been used for grounding the same. That is, the grounding connection may be effected through an amplifier circuit 010 as shown in FIG. 8*b* or through a rectifying circuit 07 as shown in FIG. 8*c*.

The grounding connection of FIG. 8*b* has the advantage that the Zener voltage Vz may be obtained as an amplifier circuit voltage, but has the disadvantage that the ripple components $e_L$ delivered through the Zener diode 04 cause fluctuations in the ground potential of the amplifier circuit, which fluctuations lead to cross modulation distortions.

On the other hand, the grounding connection of FIG. 8*c* has the advantage that such fluctuations in the ground potential of the amplifier circuit may be avoided since the ripple components $e_L$ return to the rectifier circuit, but has the disadvantage that the voltage of the amplifier circuit is the superposition of the Zener voltage Vz and an electromotive force Va due to a ground line impedance 08 between the grounding connection of the Zener diode and that of the amplifier circuit.

In attempting to solve the above problems, there has been suggested a construction using a battery 09 as the reference voltage source as shown in FIG. 8*d*.

According to this construction, the above problems of the constructions of FIGS. 8*b* and 8*c* may be solved. However, there arises a new problem of troublesome necessity of battery replacement when the battery 09 wears out.

Also, in the case of typical common-emitter type of amplifier circuit, if the collector resistance is increased in an attempt to increase the amplifying power of the circuit, the increase of the resistance necessarily causes a decrease in the collector-emitter current. In order to overcome this problem, the prior art has suggested a circuit shown in FIG. 9.

This circuit includes a constant-voltage load circuit 06 in place of the collector resistance.

More specifically, the circuit comprises a reference voltage source including a Zenor diode (or, a diode, a light emitting diode) 06*a* and a resistance 06*b*, and a voltage-current converter including a resistance 06*d* and a transistor 06*c*. If the Zener voltage is Eb, the base-to-emitter voltage of the transistor 06*c* is Vbe and the resistance value of the resistance 06*d* is $R_l$; then, the collector current $i_C$ of the transistor 03 is represented by the equation:

$$i_c = \frac{Eb - Vbe}{R_1}$$

Since Eb, Vbe and $R_l$ are constant, $i_C$ is also constant. Also, since the constant-voltage load circuit theoretically has an infinite resistance, it is possible to increase the amplifying power of the amplifier circuit. In this FIG. 9, it is to be noted, a reference numeral 011 denotes a DC power source.

However, the above circuit employs the Zener voltage as the reference voltage, and the ripples contained in the DC voltage source and voltage fluctuations resulting from load variations fluctuate the reference voltage and consequently the collector current.

A typical differential input amplifier circuit using an FET is shown in FIG. 10*a*.

In FIG. 10*a*, reference numerals 012 and 013 denote transistors using FET's constituting differential input stages. Further, a numeral 014 denotes an operational amplifier circuit, a numeral 015 denotes DC voltage source (+B, −B) and a reference numeral 016 denotes a load resistance, respectively.

Since it is necessary to deliver a constant source current to FET's 012 and 013 of the differential amplifier stages for determining operational points thereof, a constant current source is connected to a common source circuit of FET's 012 and 013.

One reason for using such a constant current source in the circuit shown in FIG. 10*b* is that a gate voltage variation causes a variation in the source resistance terminal voltage causing fluctuations in the source current, these fluctuations result in instability of the operating points of the FET's thereby increasing distortions mainly in the even order.

Incidentally, in the amplifier circuit of FIG. 10*a*, the above constant current source has a circuit construction including a resistance 018 and a Zener diode 019 serially connected between the DC current sources 015 (+B) and 015 (−B) and a transistor 020 having its base connected to the connection between the resistance 018 and the Zener diode 019, having its emitter connected to respective sources of the transistors 012 and 013 and having its collector connected to the −B power source.

In this circuit construction, the common source current $i_e$ of transistors 012 and 013 is represented by the following equation:

$$i_e = \frac{V_z - V_{BE}}{R_2}$$

where V is a Zener voltage, and $V_{BE}$ is a base-to-emitter voltage of the transistor 020.

With the above, it is possible to maintain constant the common source current of the differential amplifier stage transistors.

However, the conventional constant current circuit utilizes as the reference voltage source the Zener voltage of the Zener diode 019 or the forward voltage of the diode or light emitting diode, and also these diodes obtain their operational current through a serial connection to the resistance 018 between +B and −B as illustrated or between the GND and −B (unillustrated). As the result, there occur fluctuations in the reference voltage due to the ripples in the power supply voltage (+B, −B) and also to variations in the power supply voltage (+B, −B) associated with load current variations, whereby the source current also suffers from fluctuations.

A typical conventional DA converter is shown in FIG. 11.

In this FIG. 11, reference marks $D_1$, $D_2$, $D_3$, $D_4$ respectively denote input terminals for digital signals in the form of 4 bit binary signals, with the terminal $D_1$ corresponding to the MSB (most significant bit) and the terminal $D_4$ corresponding to the LSB (least significant bit).

Further, reference marks $S_1$, $S_2$, $S_3$, $S_4$ respectively denote switches for selecting either the source or the grounding based on the binary signal of each bit. In operation, the source is selected with an input of '1', and the grounding is selected with an input of '0'.

Also, the output terminals of these switches are connected to a ladder resistance network, and between the output terminals and the network there is generated an analog signal corresponding to the 4 bit digital signals, the analog output being represented by the following equation:

$$e_{out} = \left(\frac{1}{2}X_1 + \frac{1}{4}X_2 + \frac{1}{8}X_3 + \frac{1}{16}X_4\right)E$$

where $X_1$ through $X_4$ are either '0' or '1' and a mark E denotes a power source voltage.

In the above conventional DA converter, the switches comprise semiconductor switches.

However, since the digital signal system and the analog signal system share the same grounding, there occurs leakage of digital signals into the analog signal system through the common grounding, whereby the analog signal is deteriorated in this respect also.

In addition, there is also the problem of analog output variation resulting from fluctuations in the power source E.

SUMMARY OF THE INVENTION

Taking the above state of the art into consideration, it is the primary object of the present invention to provide a constant-voltage power supply source capable of providing a constant reference voltage and free from the troublesome replacement of a worn-out battery.

It is a further object of the present invention to provide, by using the above constant-voltage power supply source, an amplifier circuit and a DA converter overcoming the above-described shortcomings of the prior art.

In order to accomplish the above objects, a constant-voltage power supply circuit related to the present invention comprises a reference voltage circuit including light emitting element and a photosensitive element optically connected to each other and a drive power source for driving the electricphoto conversion element and the circuit uses an output voltage of the conversion element as its reference voltage.

Functions and effects of the above circuit will be specifically described next.

Since the output voltage of the photosensitive element is used as the reference voltage, the circuit enjoys the same advantageous effect as achieved by the use of battery without using any battery which necessitates an occasional battery replacement as described hereinbefore.

Next, an amplifier circuit related to the present invention comprises a constant-current load circuit including a reference voltage source and a voltage-to-current converter transistor for converting a reference voltage from the reference voltage source into a constant current, and a common emitter type amplifier circuit having its collector connected to the constant-current load circuit, the reference voltage source comprising an output voltage of a photosensitive element of a reference voltage circuit constituted by a photosensitive element and light emitting element optically coupled with each other and a driving power source for driving the light emitting element.

Functions and effects of the above amplifier circuit will be described next.

Since the constant voltage from the photosensitive element is used as the reference voltage of the constant-current load circuit constituting the amplifier circuit through the combination of the light emitting element and the photosensitive conversion element, it is possible to maintain the output current constant irrespectively of any variations in the DC voltage, thereby avoiding the prior-art problem of collector current variations due to DC power source variations.

Next, a differential input amplifier circuit related to the present invention having the above constant-voltage power source circuit, comprises a constant-current load circuit connected to transistors having differential input stages and including means for converting the reference voltage from the constant-voltage power supply circuit into a constant current, and this conveter means comprises a voltage-current converter transistor.

With the above arrangement, since the output voltage of the photosensitive element depends only on an amount of light input thereto, the same becomes free from the DC power source variations.

Accordingly, it becomes possible to avoid the prior-art problem of the emitter current variations due to the DC voltage variations and thus to achieve stable constant emitter current.

Further, a DA converter related to the present invention comprises a resistance network for delivering binary signals for each bit to a reference voltage circuit and then generating an analog signal by superposing the outputs respectively corresponding to the digital signals, the reference voltage circuit including an light emitting element and a photosensitive element optically coupled with each other and a driving power source for driving the light emitting element, the reference voltage circuit using an output voltage of the photosensitive element as a reference voltage.

According to the above DA converter, it is possible to avoid fluctuations in the analog signal thanks to the constant electromotive force of the photosensitive element, and it is also possible to avoid the disadvantageous influence of the digital signals on the analog signal through the complete separation of the groudings of the digital and analog signal systems.

In conclusion, according to the present invention, the output fluctuations due to variations in the power supply voltage may be avoided because of the constant electromotive force provided by the photosensitive element. Further, because of the complete separation of the groudings of the digital and analog signal systems, disadvantageous leakage of digital signals into the analog signal system may be avoided thereby preventing any deteriorations in the analog signal due to the influence of the digital signals.

DESCRIPTION OF THE PREFERRED EMBODIMENTS

Preferred embodiments of a constant-voltage power supply circuit related to the present invention and of an amplifier circuit and a DA converter using the constant-voltage power supply circuit will be particularly described next with reference to the accompanying drawings.

Figure 1:
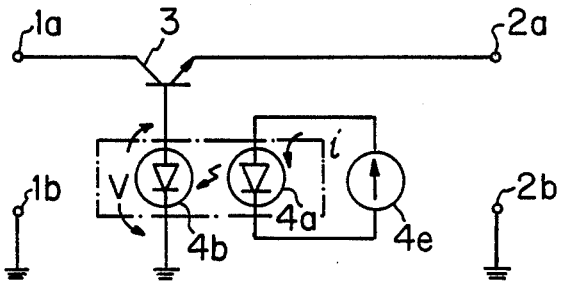
FIG. 1 is a circuit diagram illustrating a preferred embodiment of a constant-voltage power supply circuit related to the present invention.
Figure 2:
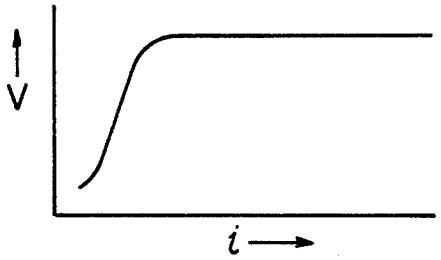
FIG. 2 is a graph showing voltage characteristics of the constant-voltage power supply circuit of the present invention.

Referring to FIG. 1, reference marks 1*a* and 1*b* denote a pair of input terminals, marks 2*a* and 2*b* denote a pair of output terminals, a reference numeral 3 denotes a control transistor having its emitter connected to the input terminal 1*a* and its collector connected to the output terminals 2*a*, reference number 4*a* denotes a light emitting element such as a light emitting diode or a lamp, reference number 4*b* denotes a photoelectic conversion element connected between a base and the ground of the control transistor 3, the element comprising a photo diode, photo transistor, a solar battery or the like. In operation, light emitted from the element is caused to enter the photosensitive element. Also, a power source E for the light emitting element is supplied from a place uninfluenced by loads such as for stabilization and rectification.

An output voltage V of the photosensitive element and a current i of the light emitting element have such characteristics that the output voltage V becomes substantially constant when the current i exceeds a predetermined value.

Accordingly, when a predetermined current is delivered to the light emitting element 4*a*, there is generated a predetermined voltage across the photosensitive element 4*b*, and this voltage may be applied to the base of the transistor 3 as a reference voltage.

Figure 3:
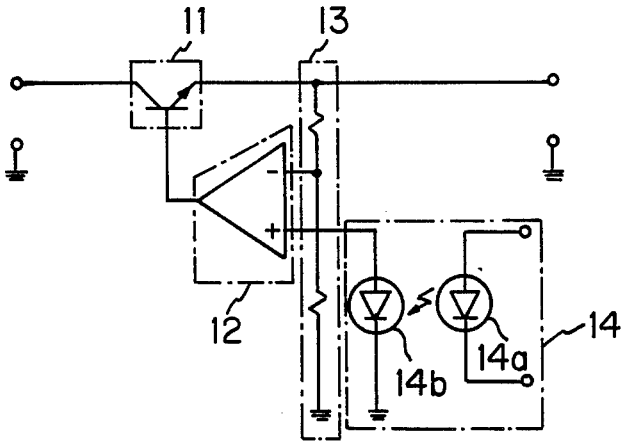
FIG. 3 is a circuit diagram illustrating a preferred embodiment of the constant-voltage power supply circuit as being actually used.

FIG. 3 shows an actual circuit construction using the constant-voltage power supply circuit related to the present invention. In this drawing, a reference numeral 11 denotes a control circuit, a numeral 12 denotes an error amplifier circuit, a numeral 13 denotes a voltage divider circuit and a reference numeral 14 denotes a reference voltage circuit, respectively. This reference voltage circuit includes a pair of a light emitting element 14*a* and a photosensitive element 14*b*.

Incidentally, it is preferred that the driving power source 4*e* to be input to the light emitting element 4*a* be picked up from a power supply line portion uninfluenced by the DC power source variations. However, even if this power source 4*e* is picked up from the DC voltage portion, as long as the light emitting element 4*a* is capable of supplying a voltage sufficient for an operation within its saturation current range, it is possible for the photosensitive element 4*b* to generate a constant voltage unaffected by the DC power source variations.

Next, an amplifier circuit using the constant-voltage power supply circuit related to the present invention will be particularly described.

Figure 4:
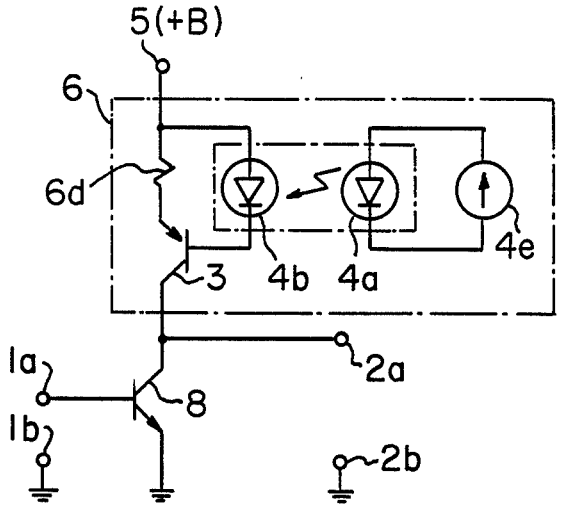
FIG. 4 is a circuit diagram showing a preferred embodiment of an amplifier circuit related to the present invention.

Referring now to FIG. 4, reference numbers 1*a* and 1*b* denote input terminals, numbers 2*a* and 2*b* denote output terminals, a reference numeral 8 denotes a common emitter type amplifier transistor, a numeral 5 denotes a DC voltage source, and a reference numeral 6 denotes a constant-current load circuit connected between a collector of the transistor and the DC power source.

This constant-current load circuit 6 includes a light emitting element 4*a* such as a light emitting diode or a lamp, a power source 4*e* for driving the element 4*a*, a photosensitive element 4*b* such as a photo transistor optically coupled with the conversion element 4*a* and a voltage-to-current convertion control transistor 3 using the output of the photosensitive element 4*b* as its base-collector input.

In operation, the light emitted from the light emitting element 4*a* excited by the driving power source 4*e* is input via optical coupling means to the photosensitive element 4*b*, which generates a voltage.

This voltage is input to the control transistor 3 acting as the voltage-to-current conversion means and the collector current from this transistor is supplied to a collector of the amplifier transistor 8.

The output voltage of the photosensitive element 4b is determined only by an amount of the light input to this element 4b and becomes unaffected by the DC power source.

Accordingly, with the above-described circuit construction, since a constant voltage is supplied to the transistor 3 irrespectively of any fluctuations in the DC power source, it is possible to maintain the collector current constant.

Incidentally, it is preferred that the driving power source 4e to be input to the light emitting element 4a be picked up from a power supply line portion uninfluenced by the DC power source variations. However, even if this power source 4e is picked up from the DC voltage portion, as long as the light emitting element 4a is capable of supplying a voltage sufficient for an operation within its saturation current range, it is possible for the photosensitive element 4b to generate a constant voltage unaffected by the DC power source variations.

Figure 5:
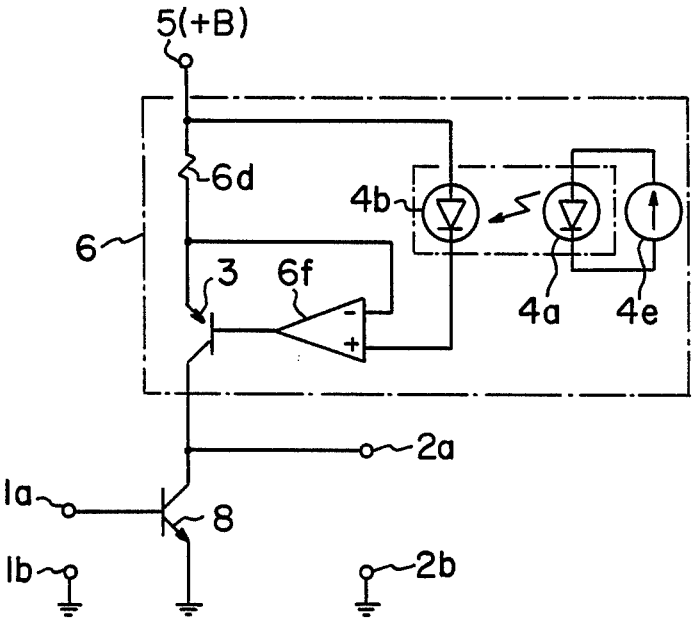
FIG. 5 is a circuit diagram of an amplifier circuit according to another embodiment of the present invention.

FIG. 5 shows an amplifier circuit according to another embodiment of the present invention.

In this amplifier circuit, the output voltage of the photosensitive element is input via an operational amplifier circuit 6f to the voltage-to-current converter transistor 3. This arrangement is advantageous in that compact conversion elements may be employed since less current is required from the photosensitive element. Moreover, there is another advantage that it is possible to restrict variations in the constant current due to signals processed by the amplifier transistor 8.

Next, a differential input amplifier circuit related to the present invention will be particularly described.

Figure 6A:
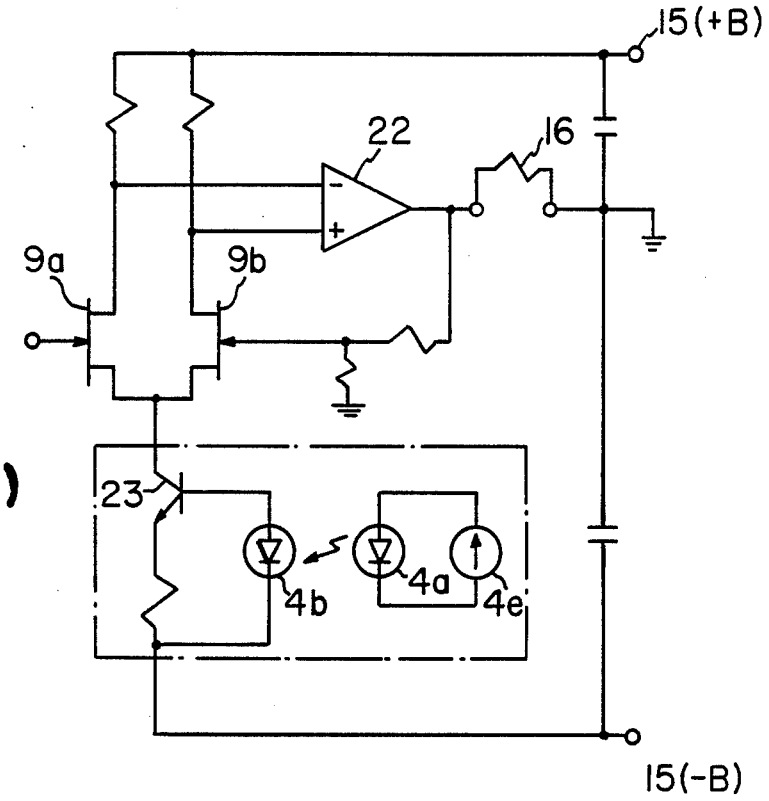
FIG. 6*a* is a circuit diagram illustrating a preferred embodiment of a differential input amplifier circuit related to the present invention.

Referring now to FIG. 6a, reference numbers 9a and 9b denote a differential amplifier stage FET, reference numeral 22 denotes an operational amplifier circuit, reference numeral 15 denotes a DC current power source (+B, −B), reference numeral 16 denotes a load resistance, respectively. Also, a reference numeral 23 denotes a transistor having its emitter connected to a common source of the differential amplifier stage FET's 9a and 9b and having its collector connected via a resistance to the DC current power source 15 (−B) and having its base connected to a terminal of the photosensitive element 4b such as a photo diode. The other terminal of this photosensitive element 4b is connected to the DC current power source 15 (−B). Further, reference number 4a denotes a light emitting element such as a light emitting diode optically coupled with the photosensitive element 4b.

In operation, the light emitted from the electricphoto conversion element 4a excited by the power source 4e causes the photosensitive element 4b to generate a voltage, and this voltage is applied to the base of the transistor 23 as the reference voltage, whereby a constant current is delivered to the common emitter of the differential amplifier stage FET's 9a and 9b.

Incidentally, it is preferred that the driving power source 4e to be input to the light emitting 4a be picked up from a power supply line portion uninfluenced by the DC power source variations. However, even if this power source 4e is picked up from the DC voltage portion, as long as the light emitting element 4a is capable of supplying a voltage sufficient for an operation within its saturation current range, it is possible for the photosensitive element 4b to generate a constant voltage unaffected by the DC power source variations.

Figure 6B:
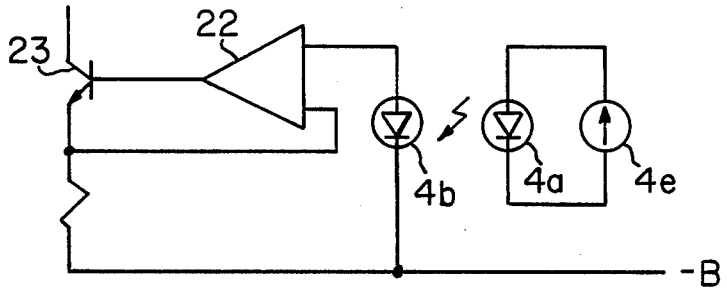
FIG. 6*b* is a partial circuit diagram illustrating a differential input amplifier according to another embodiment of the present invention.

FIG. 6b shows an alternate embodiment, in which the output of the photosensitive element 4b is input via the operational amplifier circuit 22 to the transistor 23. This construction is advantageous in that elements of small output type may be employed since less current is required from the photosensitive element 4b.

Next, a preferred embodiment of a DA converter related to the present invention will be particularly described with reference to FIG. 7.

Figure 7:
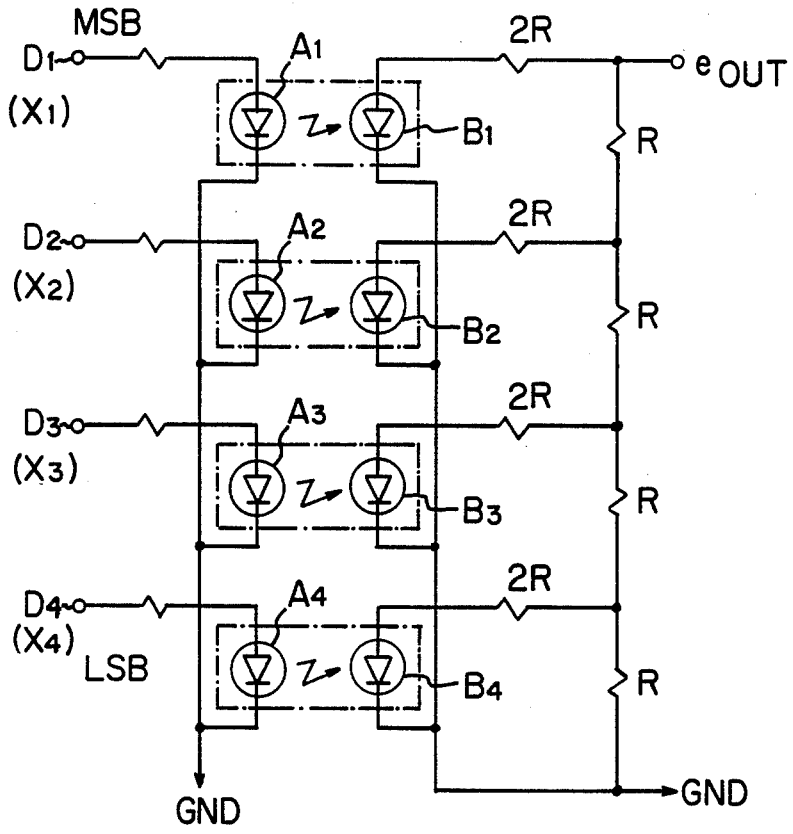
FIG. 7 is a circuit diagram illustrating a preferred embodiment of a DA converter related to the present invention.
Figure 8A:
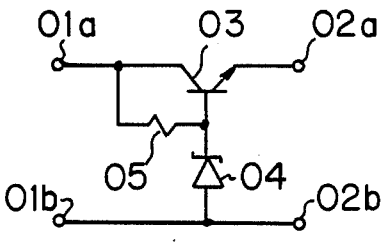
FIG. 8(a) (PRIOR ART)
FIGS. 8*a* through 8*d* are circuit diagrams showing the prior art constant-voltage power supply circuits.
Figure 8B:
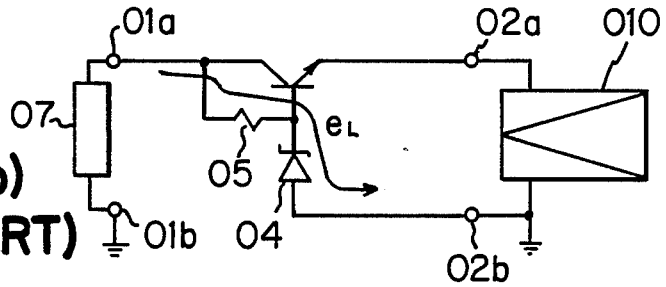
FIG. 8(b) (PRIOR ART)
Figure 8C:
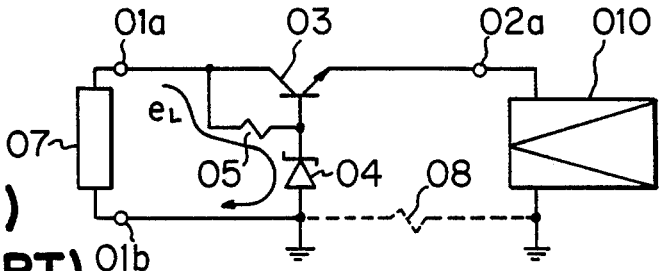
FIG. 8(c) (PRIOR ART)
Figure 8D:
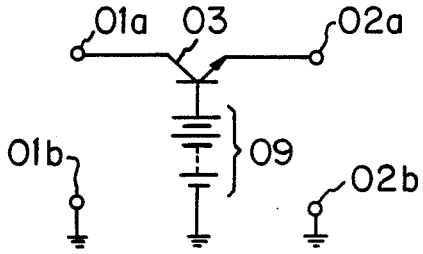
FIG. 8(d) (PRIOR ART)
Figure 9:
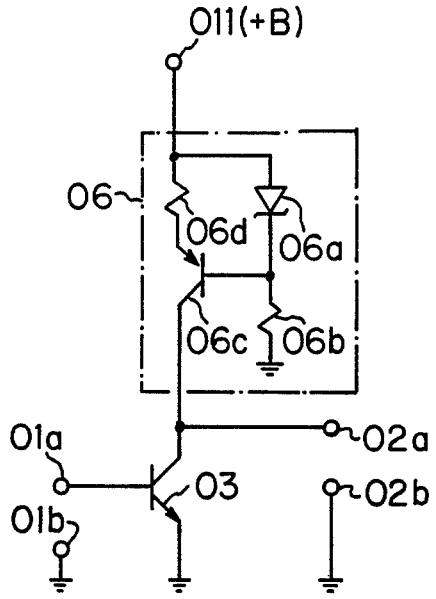
FIG. 9 (PRIOR ART)
FIG. 9 is a circuit diagram showing a prior art amplifier circuit.
Figure 11:
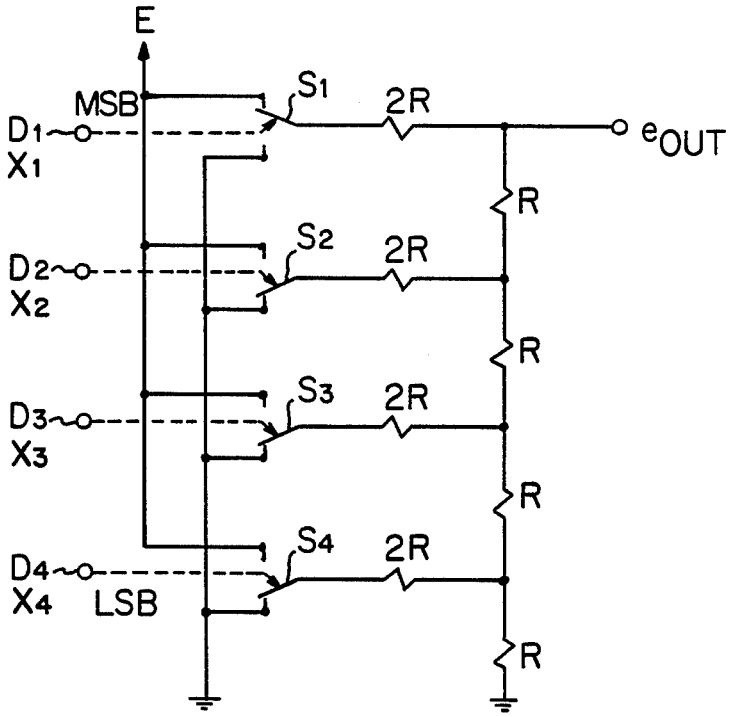
FIG. 11 (PRIOR ART)
FIG. 11 is a circuit diagram of a prior art DA converter.
Figure 10A:
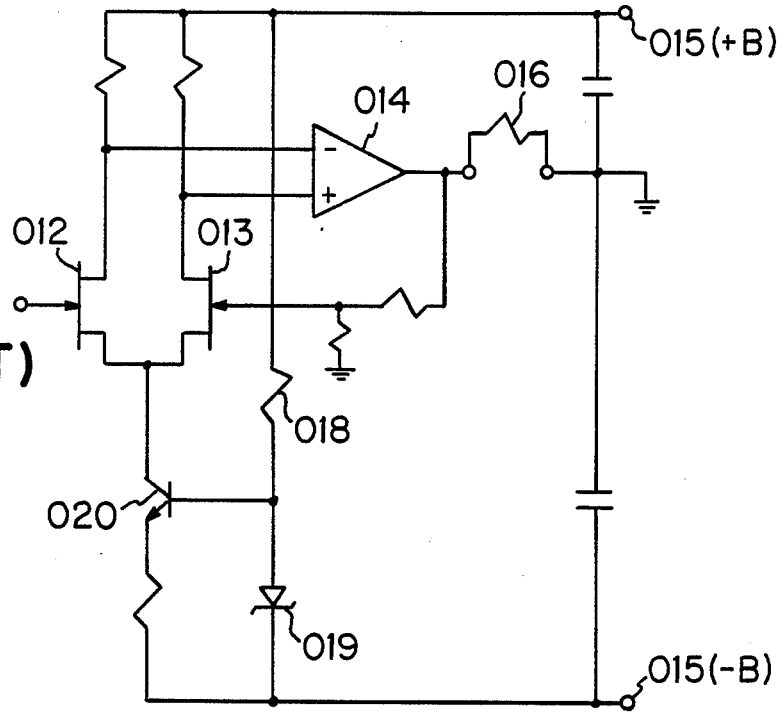
FIG. 10(a) (PRIOR ART)
FIG. 10*a* is a circuit diagram showing a prior art differential input amplifier circuit.
Figure 10B:
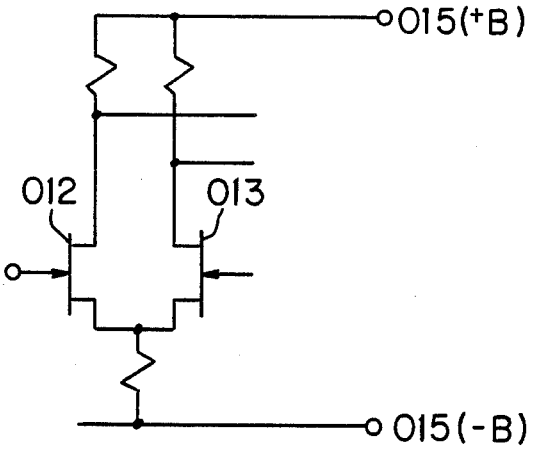
FIG. 10(b) (PRIOR ART)
FIG. 10*b* is a partial circuit diagram for further illustrating the circuit of FIG. 10*a* by comparison.

In FIG. 7, reference numbers $D_1$, $D_2$, $D_3$, $D_4$ respectively denote input terminals for receiving digital signals in the form of 4 bit binary signals, with $D_1$ corresponding to the MSB and $D_4$ corresponding to the LSB respectively.

Reference numbers $A_1$ through $A_4$ respectively denote light emitting elements receiving the binary signal for each bit. The output lights of these light emitting elements $A_1$ through $A_4$ are input via optical coupling means to the photosensitive elements $B_1$ through $B_4$ corresponding thereto.

The output voltages of these photosensitive conversion elements $B_1$ through $B_4$ are applied to corresponding portions of the ladder resistance network.

Therefore, when the binary digital signal is '1', the light emitting element is illuminated and a voltage e is generated across the photosensitive conversion element corresponding to this light emitting element.

The analog signal output of the network corresponding to the digital signals is represented by the following equation:

$$e_{out} = \left(\frac{1}{2}X_1 + \frac{1}{4}X_2 + \frac{1}{8}X_3 + \frac{1}{16}X_4\right)E$$

Incidentally, it is preferred that the optical coupling means for all of the above electricphoto elements and the photosensitive elements should comprise optical fibers or optical couplers disposed adjacent each other and accommodated in a sealed package.

What is claimed is:

1. A constant-voltage power supply circuit having a reference voltage circuit comprising:

a light emitting element and a photosensitive element optically coupled with each other; and a driving power source for driving said light emitting element such that said light emitting element emits an amount of light sufficient to cause an output voltage of said photosensitive element to reach a saturation point thereof to become a non-variable constant voltage;

wherein said non-variable constant output voltage of said photosensitive element is used as a reference voltage.

2. A constant-voltage power supply circuit as claimed in claim 1, wherein said light emitting element and photosensitive element function as an integral unit and are accommodated together in a package for forming an optical coupler.

3. A constant-voltage power supply circuit as claimed in claim 2, wherein said light emitting element is a lamp.

4. A constant-voltage power supply circuit as claimed in claim 2 wherein said light emitting element is a light emitting diode.

5. A constant-voltage power supply circuit as claimed in claim 2 wherein said photosensitive element comprises any one of a photo diode and a photo transistor.

6. An amplifier comprising:

a constant-current load circuit including, a reference voltage source, a voltage-to-current converter transistor for converting a reference voltage from said reference voltage source into a constant current;

a common emitter type amplifier transistor having a collector thereof connected to said constant-current load circuit;

wherein said reference voltage source includes a photosensitive element and a light emitting element optically coupled with each other; and a driving power source for driving said light emitting element such that said light emitting element emits an amount of light sufficient to cause an output voltage of said photosensitive element to reach a saturation point thereof; said output voltage of said photosensitive element being used as a reference voltage.

7. An amplifier circuit comprising:

a constant-current load circuit including, a reference voltage source, a voltage-to-current converter transistor for converting a reference voltage from said reference voltage source into a constant current;

a transistor having differential input stages and connected to said constant-current load circuit;

wherein said reference voltage source includes a photosensitive element and a light emitting element optically coupled with each other; and a driving power source for driving said light emitting element such that said light emitting element emits an amount of light sufficient to cause an output voltage of said photosensitive element to reach a saturation point thereof; said output voltage of said photosensitive element being used as a reference voltage.

8. An amplifier circuit as claimed in claim 7, wherein said transistor having differential input stages comprises an FET.

9. An amplifier circuit as claimed in any one of claims 6 through 8, wherein said light emitting element and photosensitive element optically coupled with each other function as an integral unit and are accommodated together in a package for forming an optical coupler.

10. An amplifier circuit as claimed in claim 9 wherein said light emitting element is a lamp.

11. An amplifier circuit as claimed in claim 9 wherein said light emitting element is a light emitting diode.

12. An amplifier circuit as claimed in claim 9 wherein said photosensitive element comprises any one of a photo diode and a photo transistor.

13. A DA converter comprising:

a resistance network for delivering binary signals for each bit of a digital signal to a reference voltage for each bit and then generating an analog signal by supplying the output voltage of each of said reference voltage circuits to an associated resistor of a ladder resistance network;

wherein each said reference voltage circuit includes a photosensitive element and a light emitting element optically coupled with each other; and a driving power source for driving said light emitting element such that said light emitting element emits an amount of light sufficient to cause an output voltage of said photosensitive element to reach a saturation point thereof; said output voltage of said photosensitive element being used as a reference voltage.

14. A DA converter as claimed in claim 13, wherein said light emitting element and photosensitive element optically coupled with each other function as an integral unit and are accommodated together in a package for forming an optical coupler.

15. A DA converter as claimed in claim 13, wherein said light emitting element is a lamp.

16. A DA converter as claimed in claim 14, 13 wherein said light emitting element is a light emitting diode.

17. A DA converter as claimed in claim 14 wherein said photosensitive element comprises any one of a photo diode and a photo transistor.

* * * * *

UNITED STATES PATENT AND TRADEMARK OFFICE

CERTIFICATE OF CORRECTION

PATENT NO. : 4,945,301

DATED : July 31, 1990

INVENTOR(S) : Yoshiro Koga, Hiroshi Kume and Kenji Nakao

It is certified that error appears in the above-identified patent and that said Letters Patent is hereby corrected as shown below:

Column 1 Line 42 "$e_s$" should read --$e_S$--.

Column 2 Line 6 after "of" (first occurrence) insert --a--.

Column 2 Line 16 change "Zenor" to --Zener--.

Column 2 Line 27 "$i_c$" should read --$i_C$--.

Column 2 Line 40 change "an" to --a--.

Column 2 Lines 56-57 "current, these" should read --current. These--.

Column 2 Line 57 after "in" insert --the--.

Column 2 Line 66 after "to" insert --the--.

Column 3 Line 9 "V" should read --$V_z$--.

Column 3 Line 52 delete "a mark".

UNITED STATES PATENT AND TRADEMARK OFFICE

CERTIFICATE OF CORRECTION

PATENT NO. : 4,945,301

DATED : July 31, 1990

INVENTOR(S) : Yoshiro Koga, Hiroshi Kume and Kenji Nakao

It is certified that error appears in the above-identified patent and that said Letters Patent is hereby corrected as shown below:

Column 4 Line 13 delete "electricphoto conversion" and insert --light emitting--.

Column 4 Line 14 delete "conversion" and insert --photosensitive--.

Column 4 Line 43 delete "conversion".

Column 5 Line 1 "an" should read --a--.

Column 5 Line 12 "groudings" should read --groundings--.

Column 5 Line 19 "groudings" should read --groundings--.

Column 6 Line 1 delete "marks" and insert --numbers--.

Column 6 Line 2 delete "marks" and insert --reference numbers--.

Column 6 Lines 8-9 delete "photoelectic conversion" and insert --photosensitive--.

UNITED STATES PATENT AND TRADEMARK OFFICE

CERTIFICATE OF CORRECTION

PATENT NO. : 4,945,301 Page 3 of 3

DATED : July 31, 1990

INVENTOR(S) : Yoshiro Koga, Hiroshi Kume and Kenji Nakao

It is certified that error appears in the above-identified patent and that said Letters Patent is hereby corrected as shown below:

Column 6 Line 12 before "element" insert --light emitting--.

Column 6 Line 62 "convertion" should read --conversion--.

Column 7 Lines 54-55 delete "electricphoto conversion" and insert --light emitting--.

Column 8 Lines 23-24 delete "conversion".

Column 8 Line 40 delete "electricphoto" and insert --light emitting--.

Claim 16 Line 38 Column 10 after "14" insert --or--.

Signed and Sealed this

Seventh Day of January, 1992

*Attest:*

HARRY F. MANBECK, JR.

*Attesting Officer* *Commissioner of Patents and Trademarks*